US005362214A

United States Patent [19]

Neward

[11] Patent Number: 5,362,214

[45] Date of Patent: Nov. 8, 1994

[54] MULTI-VACUUM RELEASE FOR PUMP

[76] Inventor: Theodore C. Neward, P.O. Box 725, Cucamonga, Calif. 91730

[21] Appl. No.: 118,493

[22] Filed: Sep. 8, 1993

[51] Int. Cl.[5] ..... F04B 41/00

[52] U.S. Cl. ..... 417/440; 251/243; 251/244

[58] Field of Search ..... 417/440, 569; 251/243, 251/244

[56] References Cited

U.S. PATENT DOCUMENTS

| | | | |
|---|---|---|---|
| 1,751,608 | 3/1930 | Tittemore et al. | 251/244 X |
| 2,612,339 | 9/1952 | Ferruzzi | 251/244 X |
| 3,211,416 | 10/1965 | Billeter et al. | 251/244 X |
| 4,806,084 | 2/1989 | Neward | 417/440 |
| 5,112,203 | 5/1992 | Neward | 417/440 |

FOREIGN PATENT DOCUMENTS

| | | | |
|---|---|---|---|
| 105050 | 7/1942 | Sweden | 251/244 |

*Primary Examiner*—Richard E. Gluck
*Attorney, Agent, or Firm*—Lyon & Lyon

[57] ABSTRACT

A hand-held vacuum pump with an attached vacuum release valve is disclosed. The vacuum release valve is oriented so that the hand-held vacuum pump and the vacuum release valve can be operated with the same hand. The vacuum release valve is operated using a trigger, allowing the operator to easily and controllably release the vacuum. The trigger is shaped to allow the operator to vary the vacuum release rate without changing the physical features of the mechanism. Further, a detachable trigger extension is disclosed which will enable operator's with small hands to operate the device with one hand.

11 Claims, 5 Drawing Sheets

FIG. 5
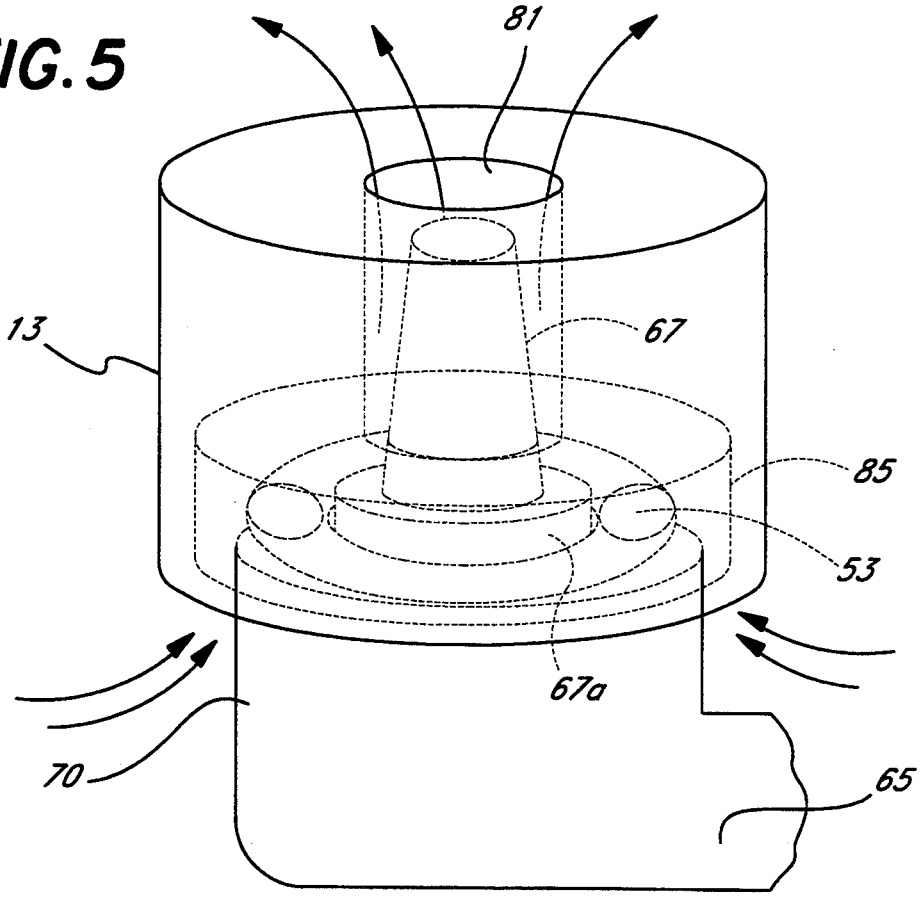
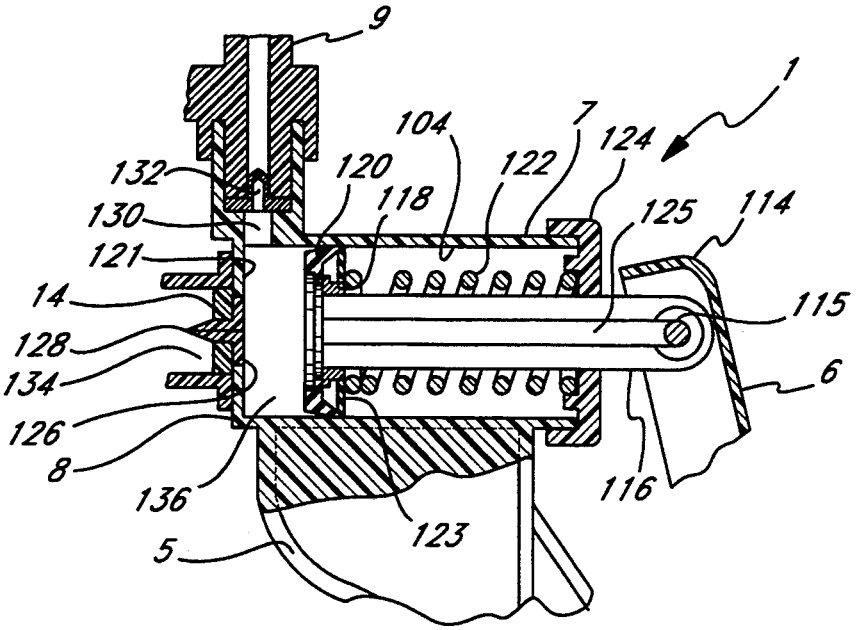
FIG. 1a

MULTI-VACUUM RELEASE FOR PUMP

FIELD OF INVENTION

This application relates to the field of vacuum and pressure pumps, particularly of the hand-held type disclosed in U.S. Pat. Nos. 3,612,722, 4,775,302, 4,806,084, 4,954,054, and 5,112,203 by the present inventor, the disclosures of which are incorporated by reference.

BACKGROUND

Hand-held vacuum and pressure pumps are generally useful whenever vacuum or pressure is desired. Vacuum or pressure can be created, for example, by compressing (i.e. squeezing) and releasing a handle of such a vacuum or pressure pump. Generally, such squeezing and releasing causes a piston to move in a cylinder of the pump thereby creating vacuum or pressure.

Such hand-held vacuum and pressure pumps are especially useful for various tasks such as aiding in performing vacuum extractions during childbirth, and are useful in various industries, such as the automotive industry, for liquid sampling and vacuum system testing and repair.

Since hand-held vacuum pumps are generally operated by one hand, it has been necessary in many cases to use the operator's second hand to operate a vacuum release valve. As will be appreciated, this can be cumbersome, especially when operating a vacuum release valve in a confined environment with limited maneuverability, where there may be fluids or lubricants present, or when there are time restrictions or psychological pressures. Furthermore, it may be desirable to limit the release of the vacuum in a controlled manner, and with minimal finger pressure and dexterity.

The above-referenced U.S. Pat. Nos. 4,806,084 and 5,112,203 describe and disclose vacuum release valves. The '084 patent describes a relatively simple vacuum release valve attached to a vacuum pump which can be released relatively easily by a finger of the same hand that is operating the pump. However, for some applications, the '084 vacuum release valve may release the vacuum too quickly or require greater dexterity than possessed by the operator. Moreover, use of the '084 vacuum release valve could be cumbersome in that the release is not biased to either the "closed" or the "open" position. Hence, the operator might become frustrated in unsuccessfully attempting to draw a vacuum when the vacuum release valve is set to the "open" position.

The '203 patent describes a vacuum release valve which is attached to a vessel in which a vacuum is drawn, and where the vacuum release valve is biased to a closed position. Furthermore, the vacuum release valve described can release a vacuum relatively easily in response to finger pressure. However, for some applications, the '203 vacuum release valve may not be optimal because the mechanism is attached to the vessel in which a vacuum is drawn and not to the vacuum pump itself. In addition, although the rate of flow of air entering and exiting the vacuum may be customized, it is done so by altering the physical size of the passageways in the plunger.

It would be beneficial to have a release mechanism which allows a variety of release rates without the necessity of changing the physical features of the mechanism.

SUMMARY OF THE INVENTION

A vacuum release device of the present invention is designed to release a vacuum in a convenient and controlled manner. The vacuum may have been created in a closed vacuum vessel or in other ways, such as by using a cup-shaped extractor for assisting in child birth. The invention is an improvement on the prior art because it not only allows the operator to release the vacuum with a single finger while at the same time grasping the handheld vacuum pump with the same hand, but also allows the operator to more quickly and accurately create and control the amount of vacuum released and therefore the vacuum pressure.

According to an exemplary embodiment of the invention, a vacuum release valve is attached to a hand-held pump. The vacuum release valve comprises a base and a trigger and is biased to a closed position by a spring. The base is attached to an opening leading from a vacuum. (Note that the term "vacuum", as defined in Webster's New Universal Unabridged Dictionary, can be used to describe the actual space "containing air or gas at a pressure below that of the atmosphere", or to describe the state "of having a vacuum.") The trigger is pivotally mounted on the vacuum release valve base. It includes a trigger arm and an actuating arm, the latter of which has a tapered boss with an o-ring that is mounted so as to stop the flow of air or gas when in the closed position. The actuating arm and boss are spring loaded so that they are biased to a "closed" position.

Accordingly, it is an object of the present invention to provide an improved hand-held vacuum pump which is operable with a single hand and which enables a vacuum to be easily and controllably released by finger action of the hand which operates the pump.

Another object of the present invention is to provide an improved vacuum release valve for a hand-held vacuum pump.

Another object of this invention is to provide a relatively inexpensive, easily manufactured, compact pump and vacuum release valve.

Another object of this invention is to provide a vacuum release valve which enables a vacuum to be released manually at a controlled release rate.

Another object of this invention is to provide a vacuum release valve which releases a vacuum at a variety of release rates without the necessity of changing the physical features of the mechanism.

BRIEF DESCRIPTION OF THE DRAWINGS

These and other objects of the present invention will become better understood through a consideration of the following description taken in conjunction with the drawings in which:

FIG. 1A is a detailed view of the vacuum pump components.

FIG. 5 is a perspective view of air or gas flow through the vacuum release valve in an "open" position (note that gas or air passes into the vacuum when the vacuum is released).

DETAILED DESCRIPTION

Figure 1:
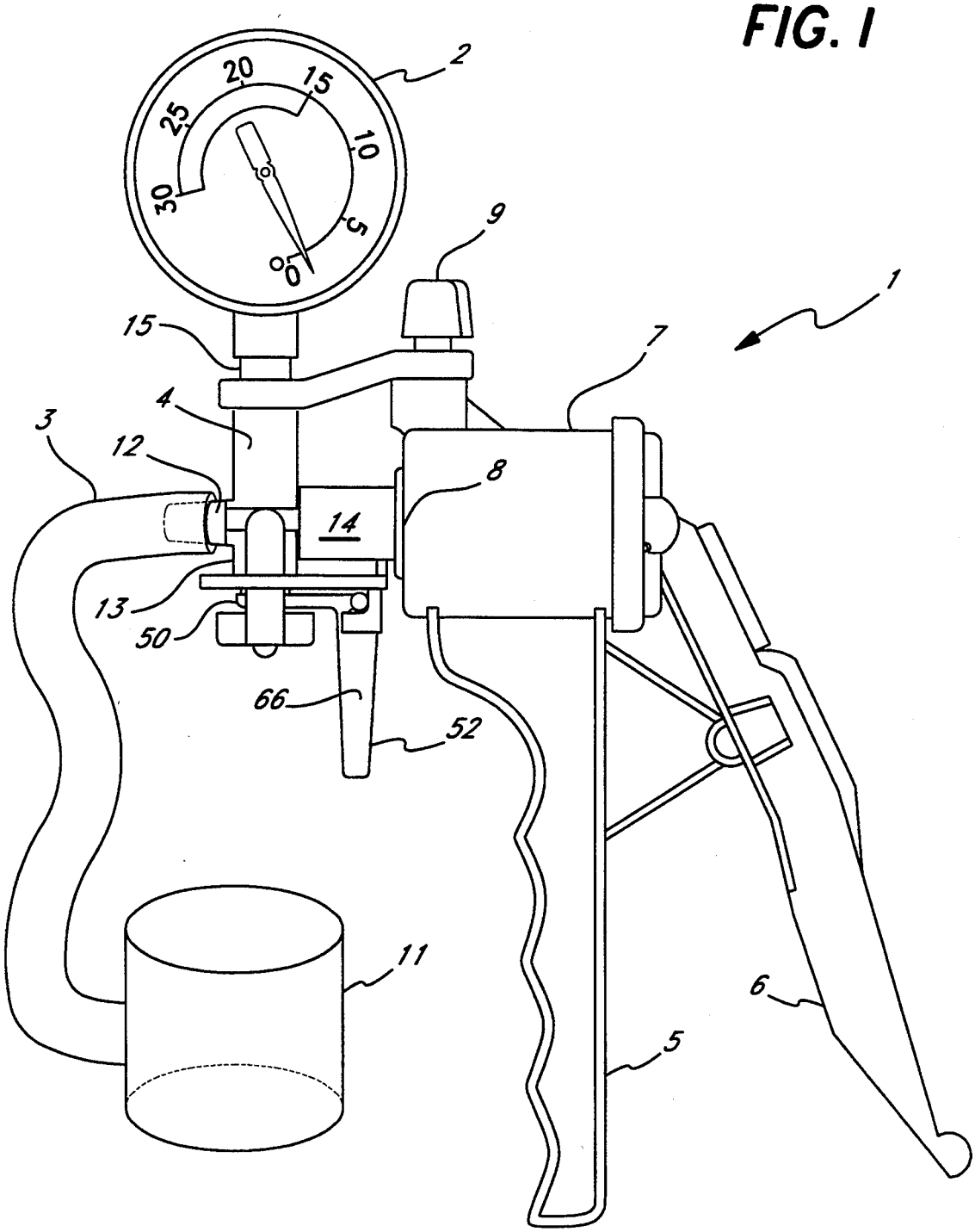
FIG. 1 is a side view of the vacuum system showing a handheld vacuum pump, a vacuum release valve, a vacuum gauge, tubing, a manifold, a vessel, and an exhaust port.

Turning now to the drawings, FIG. 1 depicts a vacuum pump 1 of the type disclosed in the referenced patents, with a length of tubing 3 connecting the pump 1 to a device for which the vacuum is desired. This can be either a closed vessel 11, or an open vessel, such as a cup used for extracting babies during childbirth (not shown). A vacuum gauge 2 can be used to indicate the pressure. As more fully described in U. S. Pat. No. 4,806,084 and the other referenced patents, the pump 1 comprises fixed and movable handles 5,6 which can be squeezed together to operate a piston within a sealed cylinder 7 as will be described in more detail subsequently in a discussion of FIG. 1A. This motion of the piston causes air to be drawn from the target vessel 11 or cup, through the tubing 3, through a manifold 4 and a piston inlet port 8 into the sealed cylinder 7, and then to be released through an exhaust port 9. The manifold 4 comprises a plurality of ports to connect the following components. A vacuum pump port 14 connects to the pump 1, a vacuum source port 12 connects to the tubing 3, a vacuum gauge port 15 connects to the vacuum gauge 2, and a vacuum release valve port 13 connects to a vacuum release valve 50. The manifold 4 may be integrally molded as part of the pump 1 (as shown in FIG. 1), or screwed on, with screw receptacles 10 (as shown in FIG. 2).

Figure 2:
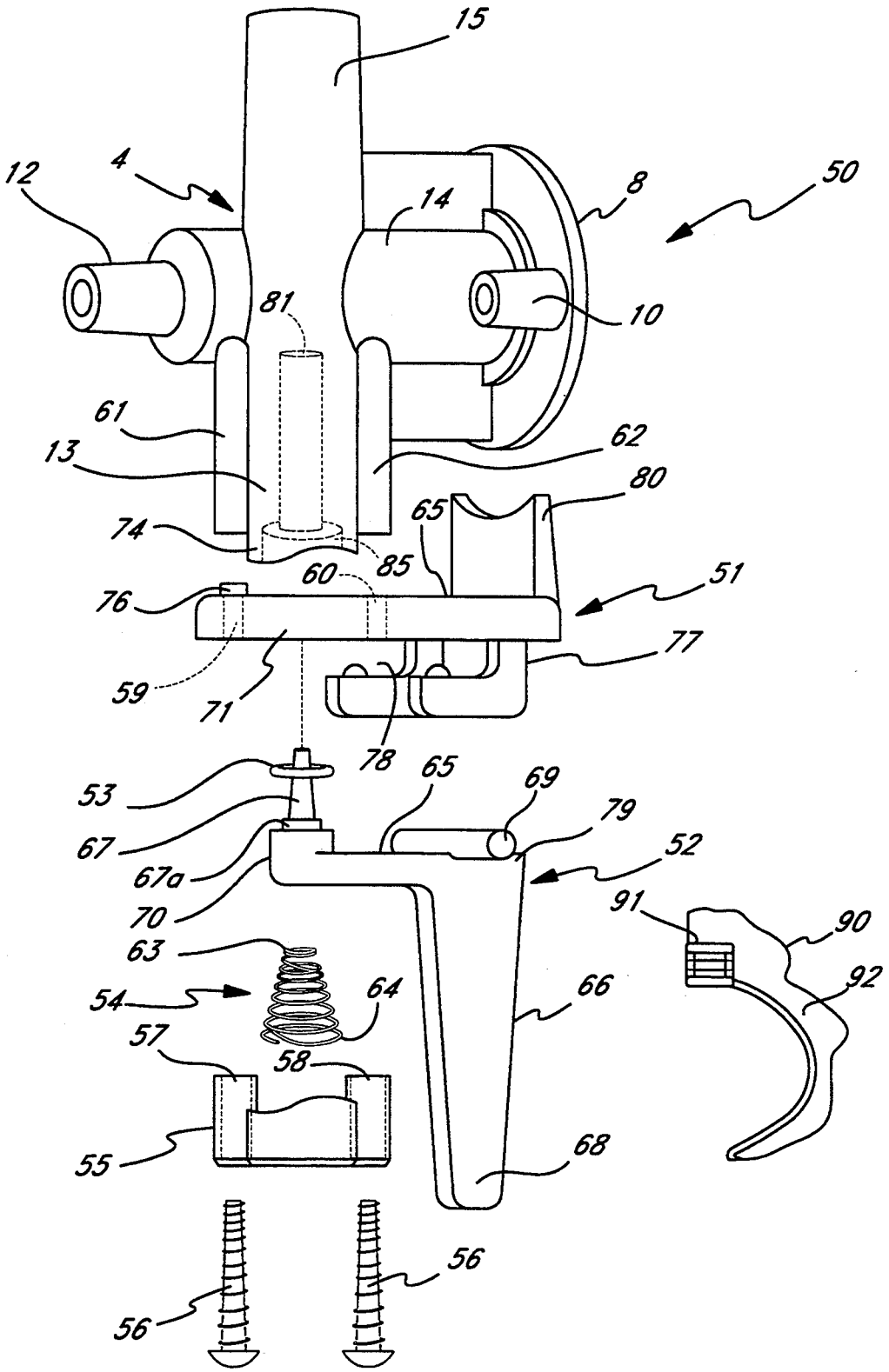
FIG. 2 is an exploded view of the vacuum release valve of FIG. 1 showing the interrelationship of the components.

Referring to FIG. 2, the preferred embodiment of the vacuum release valve 50 is shown. The vacuum release valve has the following major components, a base 51, trigger 52, O-ring 53, spring 54, spring base 55, and screws 56.

FIG. 1A illustrates the interior details of the pump 1 as disclosed in U.S. Pat. No. 4,806,084. The pump includes a fixed handle 5 which is attached to the cylinder 7. A movable handle 6 is coupled to a piston rod 116 which extends into a cylindrical chamber 104 of the cylinder 7 and terminates in a cylindrical piston cap 118 with a resilient cylindrical piston 120 disposed thereon. The cap 118 and piston 120 are shown slightly drawn back from the inner end 121 of the cylindrical chamber 104. The piston 120 is normally pressed to the inner end of the cylinder 104 by springs 122. One end of the spring 122 bears against a cap 124 secured to the outer end of the cylinder 7, and the other end of the spring 122 bears against a spreader ring 123. The spring 122 thus presses against the backside of the spreader ring 123 which in turn presses against the back side of the piston 120 to thereby improve the seal between the piston 120 and the cylinder 104.

At the inner end of the chamber 104 is a first recessed area 126 where an umbrella valve 128 is placed. Also, at the inner end of the chamber 104 is a second recessed area 130 at which a separate duckbill valve 132 is placed. The second area 130 is normal to the axis of the chamber 104, and the piston 120 can cover and seal this second recessed area 130 when the piston is at the end of the chamber. As will be apparent to those skilled in the art, as the piston is pulled back, air will be drawn from the pump's inlet area 134 into the area 136 evacuated by the piston 120. When the handle is released and the spring-loaded piston 120 returns to the inner end 121 of the chamber 104, the air in the cylinder's evacuated area 136 will be forced to exit via the duckbill valve 132 to the exhaust area 9.

At rest, the vacuum release valve 50 is biased to a "closed" position, so that no air or gas can enter the vacuum. To operate the vacuum release valve 50, a force is applied by a human finger on the trigger 52, moving a trigger arm 66 to the right in FIGS. 1 & 2. The trigger 52 pivots on a notch 78, forcing an actuating arm 65 downward and depressing the spring 54. This results in the vacuum release valve 50 being in an "open" position, thus allowing air to enter the vacuum and the vacuum to be released.

The flow of air through the vacuum release valve 50 in the open position is illustrated in FIG. 5. There, the connection between the vacuum release valve port 13 and the actuating arm 65, a shoulder 70, a boss 67 a base 67*a* and the o-ring 53 is illustrated. The port 13 contains an internal channel 81. This flow can be easily controlled as discussed below to allow a selective release of air to adjust the vacuum level. The operator can vary the volume of gas (usually air) passing through the vacuum release by using the trigger 52 (see FIG. 1). Pressing the trigger 52 all the way back will cause more air to enter the vacuum, whereas a partial opening will allow less air to enter and allow the operator to control the outflow. This control over the vacuum release is a result of the taper of the boss 67 which is frustoconical in shape. Its base 67*a* has a diameter substantially the same as the internal diameter of the hole in the o-ring 53, and the o-ring is mounted to encircle the base 67*a*. When the trigger has not been pulled, the o-ring 53 fits snugly against a recessed area 85 of the manifold channel 81, providing a seal so that no air can enter the vacuum. As the trigger 52 is pulled, the o-ring 53 moves away from the surface of the recessed area 85, thereby allowing air to pass into the vacuum. The tapered wall of the boss 67 allows gradual release of the vacuum by varying the opening between the boss 67 and the internal diameter of the manifold channel 81. The size of the opening increases proportionally to the distance that the trigger 52 is depressed. The flow rate of air can be adjusted or selected in manufacture by changing the taper of the boss 67; that is, it can be tapered more to allow air to enter the vacuum faster with a smaller movement of the trigger 52. By using the vacuum pump to increase the pressure, and the vacuum release to gradually reduce the pressure, the operator can easily and accurately control the vacuum pressure for the desired application.

Turning again to FIG. 2, the base 51, spring base 55, and manifold 4 are held together by a pair of screws 56. The screws 56 are inserted through holes 57 & 58 of the spring base 55 and through holes 59 & 60 (also see FIG. 3A) of the base 51, and into the cylindrical screw receptacles 61 & 62 that are molded into the sides of the manifold 4. The position of the screws 56, screw receptacles 62 & 62, screw holes 57–60, and vertical posts 76 are oriented 90 degrees different in FIG. 2 from that shown in FIGS. 1 & 3A–C. The base 51 is held in place by being sandwiched between the manifold 4 and the spring base 55 when the screws 56 are tightened. A lower part 64 of the spring 54 is seated in a recessed portion of the spring base 55. An upper part 63 of the spring 54 rests against a recessed portion of the bottom of the actuating arm 65 of the trigger 52. The upward force from the spring 54 biases the vacuum release valve to the "closed" position when at rest. In the "closed" position, the upper portion of the boss 67 is positioned inside the manifold channel 81. As described above, the o-ring 53 fits snugly against a recessed area 85 of the manifold channel 81, providing a seal so that no air can enter the vacuum.

Figure 4B:
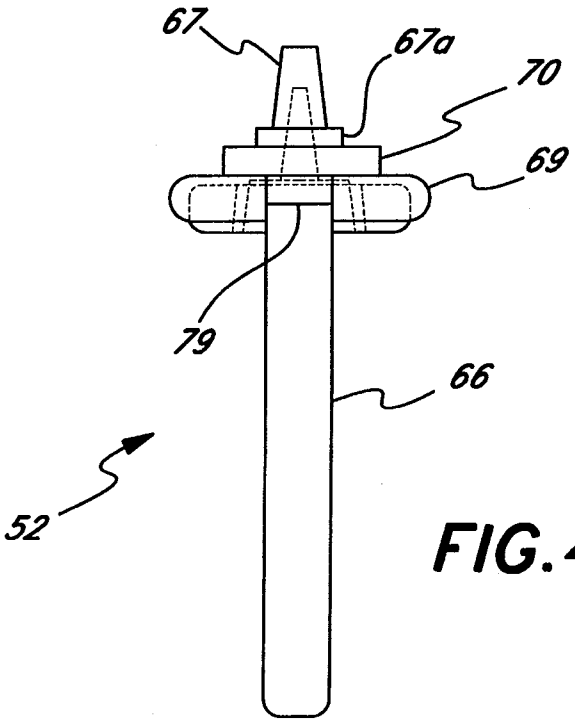
FIG. 4B is a rear view of the trigger used to open and close the vacuum release valve.
Figure 4C:
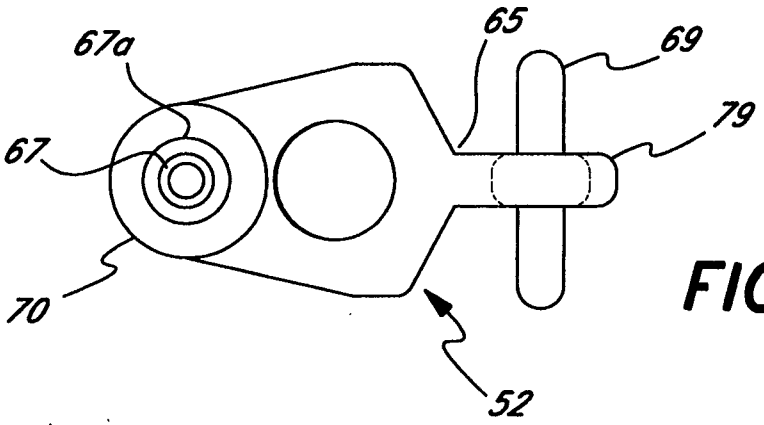
FIG. 4C is a top view of the trigger used to open and close the vacuum release valve.
Figure 4A:
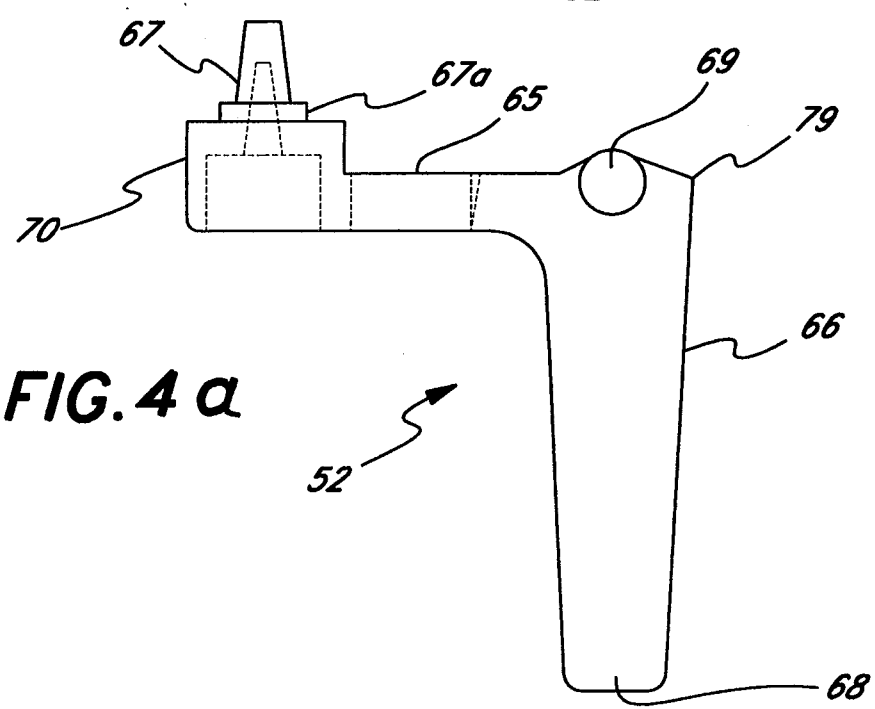
FIG. 4A is a side view of the trigger used to open and close the vacuum release valve.

Referring again to FIG. 2, the trigger 52 comprises a trigger arm 66 with wings 68, a perch 69, and an actuating arm 65 with a shoulder 70 and a boss 67. FIGS. 4A–C show the side, rear, and top views of the trigger 52. A detachable trigger extension 90 is shown in FIG. 2. This extension 90 enables operators with small hands to operate the vacuum pump 1 and the vacuum release valve 50 with a single hand. The extension 90 can be attached to the trigger arm 66 using a three-ribbed connecter 91. Two of the ribs are positioned on one side of the trigger arm 66, and the third is positioned on the opposite side. A rib 92 runs the entire length of the extension 90 in order to give the extension 90 structural rigidity.

Figure 3A:
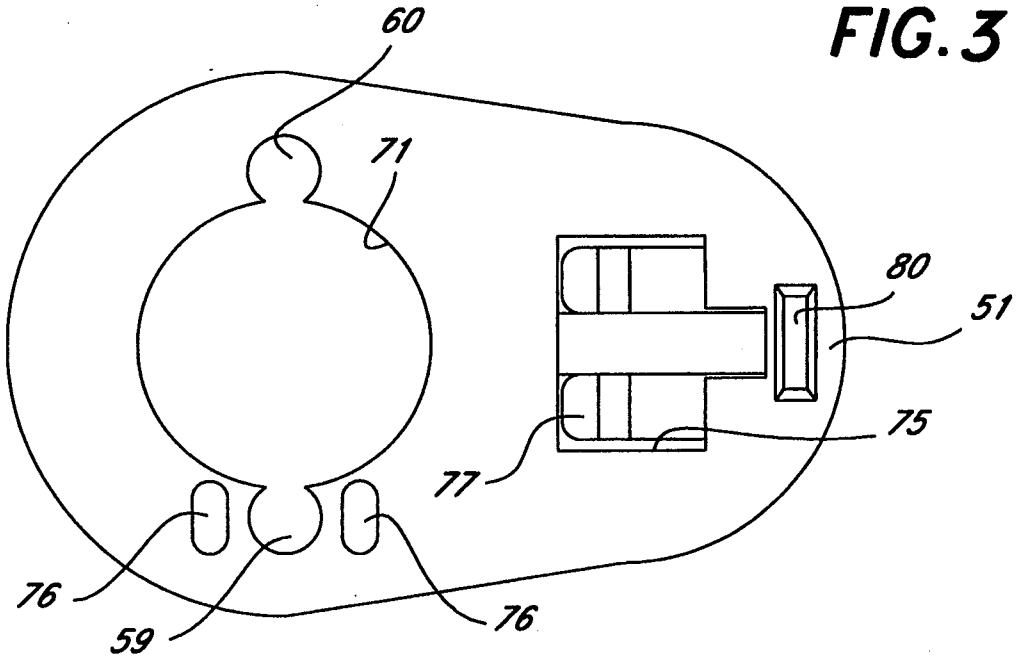
FIG. 3A is a plan view of the vacuum release valve base.
Figure 3B:
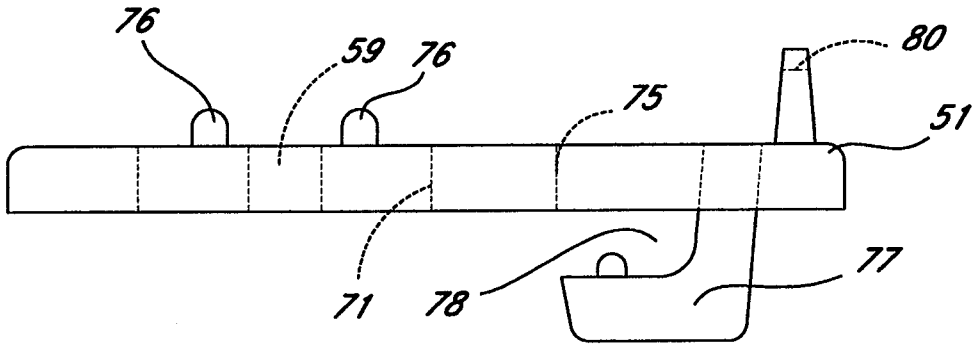
FIG. 3B is a side view of the vacuum release valve base.
Figure 3C:
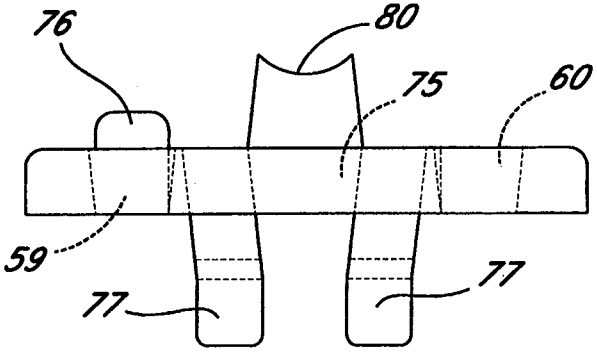
FIG. 3C is a rear view of the vacuum release valve base.

The base 51, as shown in FIGS. 3A, 3B & 3C, has three different cavities (or sets of cavities). The first is a circular cavity 71 whereby the bottom portion 74 of the vacuum release valve port 13 rests (as shown in FIG. 2). In the preferred embodiment, the outer portion of the vacuum release valve port 13 is seated inside this cavity 71, supported by the screw receptacles 61 & 62. Second, there are two screw holes 59 & 60. Third, there is a substantially rectangular cavity 75 to allow the rear portion 79 of the trigger 52 to fit in when operated in the "open" position. There are two vertical posts 76 beside one of the screw holes 59 to enable guiding the cylindrical screw receptacles 61 & 62 into place for assembly. There are a pair of notch arms 77 on the bottom side of the base 51, forming a notch 78 where the trigger 52 can pivot. A vertical support 80 is molded into the rear part (right side of FIGS. 3A & 3B) to fit between the vacuum pump port 14 and the base 51.

While embodiments of the present invention have been shown and described, various modifications may be made without departing from the scope of the present invention, and all such modifications and equivalents are intended to be covered.

The invention claimed is:

1. A hand-held vacuum pump, comprising cylinder means for isolating a certain volume from the atmosphere and equipped with a piston inlet port and an exhaust port, biased piston means, for drawing a vacuum through said piston inlet port of the cylinder means when said biased piston means is drawn back, and for automatically returning said piston means to the end of said cylinder when said piston means is no longer drawn back, a first valve coupled with said piston inlet port of the cylinder means, a second valve coupled with said exhaust port of the cylinder means, said second valve being separate from the first valve, hand-operated piston retractor means for drawing said piston means back within said cylinder means, whereby drawing said piston means back causes air to be drawn into said cylinder means via said piston inlet port of the cylinder means, and whereby releasing said piston retractor means causes the air which was drawn in to be forced out via said exhaust port of said cylinder means, and a vacuum release valve comprising a substantially hollow manifold comprising a vacuum source port, a vacuum pump port, and a vacuum release valve port, a base connectable to said vacuum release valve port, and including a cavity therethrough, through which a trigger can contact said vacuum release valve port, said trigger being pivotally mounted on the base and having a trigger arm, an actuating arm, and a boss with an o-ring seal for stopping the flow of gas into the vacuum release valve port when in a closed position, and allowing gas to enter when in an open position, a spring mounted on the side of the actuating arm opposite said boss and aligned substantially coaxial with said boss and providing a force to bias said actuating arm and boss into the closed position when at rest, and requiring pressure on said trigger arm to move said actuating arm and boss to the open position, and a spring base for mounting said spring.

2. A hand-held vacuum pump having a vacuum release valve, the vacuum release valve comprising a substantially hollow manifold comprising a vacuum source port, a vacuum pump port, and a vacuum release valve port, a base connectable to said vacuum release valve port, and including a cavity therethrough, through which a trigger can contact said vacuum release valve port, said trigger being pivotally mounted on the base and having a trigger arm, an actuating arm, and a boss with an o-ring seal for stopping the flow of gas into the vacuum release valve port when in a closed position, and allowing gas to enter when in an open position, a spring mounted on the side of the actuating arm opposite said boss and aligned substantially coaxial with to said boss and providing a force to bias said actuating arm and boss into the closed position when at rest, and requiring pressure on said trigger arm to move said actuating arm and boss to the open position, and a spring base for mounting said spring.

3. The hand-held vacuum pump having a vacuum release valve of claim 2 wherein said base, trigger, spring, and spring base are interconnected such that they can be removably attached to the vacuum release valve port as a single unit.

4. The hand-held vacuum pump having a vacuum release valve of claim 2 wherein the trigger boss is substantially conical in shape, whereby said conical boss is sized so that it enters the interior of said internal channel of said vacuum release valve port in either the open or the closed position, whereby the diameter of the outer surface of the boss is less than the inner diameter of the interior of said internal channel, whereby the flow rate of gas entering said vacuum release valve port when in the open position is variable dependent upon the amount that said trigger is depressed.

5. The hand-held vacuum pump having a vacuum release valve of claim 2 wherein said manifold additionally comprises a vacuum gauge port.

6. The hand-held vacuum pump having a vacuum release valve of claim 2 wherein said trigger has a detachable trigger extension which can be attached to said trigger arm to allow human operators with small hands to operate said hand-held pump with one hand.

7. A hand-held vacuum pump having a vacuum release valve, the vacuum release valve comprising a substantially hollow manifold comprising a vacuum source port, a vacuum pump port, and a vacuum release valve port, a base connectable to said vacuum release valve port, the base further including a cavity therethrough through which a trigger can contact said vacuum release valve port, said trigger being pivotally mounted on the base and having a trigger arm, an actuating arm, and a boss for stopping the flow of gas into the vacuum release valve port when in a closed position, and allowing gas to enter when in an open position, and a spring mounted on the actuating arm aligned substantially coaxial with to said boss and providing a force to bias said actuating arm and boss into the closed position, and requiring pressure on said trigger arm to move said actuating arm and boss to the open position.

8. The hand-held vacuum pump having a vacuum release valve of claim 7 wherein said base, trigger and spring are interconnected such that they ca be removably attached to the vacuum release valve port as a single unit.

9. The hand-held vacuum pump having a vacuum release valve of claim 7 wherein said trigger boss is substantially conical in shape.

10. The hand-held vacuum pump having a vacuum release valve of claim 7 wherein said manifold additionally comprises a vacuum gauge port.

11. The hand-held vacuum pump having a vacuum release valve of claim 7 wherein said trigger has a detachable trigger extension.

* * * * *